US012790655B2

(12) United States Patent
Na et al.

(10) Patent No.: US 12,790,655 B2
(45) Date of Patent: Nov. 10, 2026

(54) HIGH-STRENGTH STEEL SHEET HAVING EXCELLENT THERMAL STABILITY, AND METHOD FOR MANUFACTURING SAME

(71) Applicant: POSCO CO., LTD, Pohang-si (KR)

(72) Inventors: Hyun-Taek Na, Seoul (KR); Sung-Il Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 691 days.

(21) Appl. No.: 18/028,439

(22) PCT Filed: Oct. 14, 2021

(86) PCT No.: PCT/KR2021/014214
§ 371 (c)(1),
(2) Date: Mar. 24, 2023

(87) PCT Pub. No.: WO2022/086049
PCT Pub. Date: Apr. 28, 2022

(65) Prior Publication Data

US 2023/0357880 A1 Nov. 9, 2023

(30) Foreign Application Priority Data

Oct. 23, 2020 (KR) ..... 10-2020-0138313

(51) Int. Cl.

| | |
|---|---|
| ***C21D 9/46*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C23C 2/06*** | (2006.01) |
| ***C23C 2/12*** | (2006.01) |
| ***C23C 2/40*** | (2006.01) |

(52) U.S. Cl.
CPC ..... *C21D 9/46* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C23C 2/06* (2013.01); *C23C 2/12* (2013.01); *C23C 2/40* (2013.01); *C21D 2211/002* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | |
|---|---|---|---|
| 2006/0081312 | A1 | 4/2006 | Yokoi et al. |
| 2010/0258219 | A1 | 10/2010 | Ahn et al. |
| 2012/0295123 | A1 | 11/2012 | Abe et al. |
| 2014/0174608 | A1 | 6/2014 | Miyata et al. |
| 2014/0261914 | A1 | 9/2014 | Jamwal et al. |
| 2016/0032438 | A1 | 2/2016 | Hirata et al. |
| 2017/0183753 | A1 | 6/2017 | Pipard et al. |
| 2018/0237874 | A1 | 8/2018 | Yamazaki et al. |
| 2020/0080167 | A1 | 3/2020 | Kim et al. |
| 2021/0164070 | A1 | 6/2021 | Na et al. |
| 2021/0269892 | A1 | 9/2021 | Kim et al. |

FOREIGN PATENT DOCUMENTS

| | | | |
|---|---|---|---|
| CN | 101883875 | A | 11/2010 |
| CN | 102725431 | A | 10/2012 |
| CN | 103597102 | A | 2/2014 |
| CN | 104818427 | A | 8/2015 |
| CN | 105121681 | A | 12/2015 |
| CN | 107849663 | A | 3/2018 |
| EP | 3816311 | A1 | 5/2021 |
| JP | 2001226744 | | 8/2001 |
| JP | 2001335889 | A | 12/2001 |
| JP | 2007302992 | A | 11/2007 |
| JP | 4306078 | B2 | 7/2009 |
| JP | 2017526812 | A | 9/2017 |
| JP | 2019151914 | A | 9/2019 |
| JP | 2020509172 | A | 3/2020 |
| KR | 19970043167 | | 7/1997 |
| KR | 100358939 | | 1/2003 |
| KR | 20050085873 | | 8/2005 |
| KR | 20110061807 | A | 6/2011 |
| KR | 20120121811 | | 11/2012 |
| KR | 20130002176 | | 1/2013 |
| KR | 101290382 | | 7/2013 |
| KR | 20140044498 | | 4/2014 |
| KR | 20150007609 | | 1/2015 |
| KR | 20150133838 | | 11/2015 |
| KR | 20160025185 | | 3/2016 |
| KR | 20180018803 | | 2/2018 |
| KR | 20200007231 | A | 1/2020 |
| KR | 20200011742 | | 2/2020 |
| WO | 2020003499 | A1 | 1/2020 |

OTHER PUBLICATIONS

Chinese Office Action—Chinese Application No. 202180072516.5 issued on Dec. 31, 2024, citing CN 101883875, CN 102725431, CN 103597102, CN 105121681, CN 107849663, and KR 10-2015-0007609.

International Search Report—PCT/KR2021/014214 dated Jan. 26, 2022.

European Search Report—European Application No. 21883120.4 issued on Oct. 31, 2024, citing KR 10-2020-0007231, WO 2020/003499, and JP 4306078.

(Continued)

*Primary Examiner* — Jophy S. Koshy
(74) *Attorney, Agent, or Firm* — CANTOR COLBURN LLP

(57) ABSTRACT

Provided is a steel sheet that can be applied to automobile chassis parts and the like, and more particularly, to a steel sheet having excellent thermal stability while having high strength to have excellent strength and bake hardening ability even after a heat treatment at a relatively low temperature.

4 Claims, 1 Drawing Sheet

(56) References Cited

OTHER PUBLICATIONS

Japanese Office Action—Japanese Application No. 2023-524296 issued on Aug. 20, 2024, citing JP 2020-509172, JP 2017-526812, JP 2007-302992, JP 2019-151914, JP 2001-335889, US 2014/0261914, KR 10-2011-0061807, and CN 104818427.

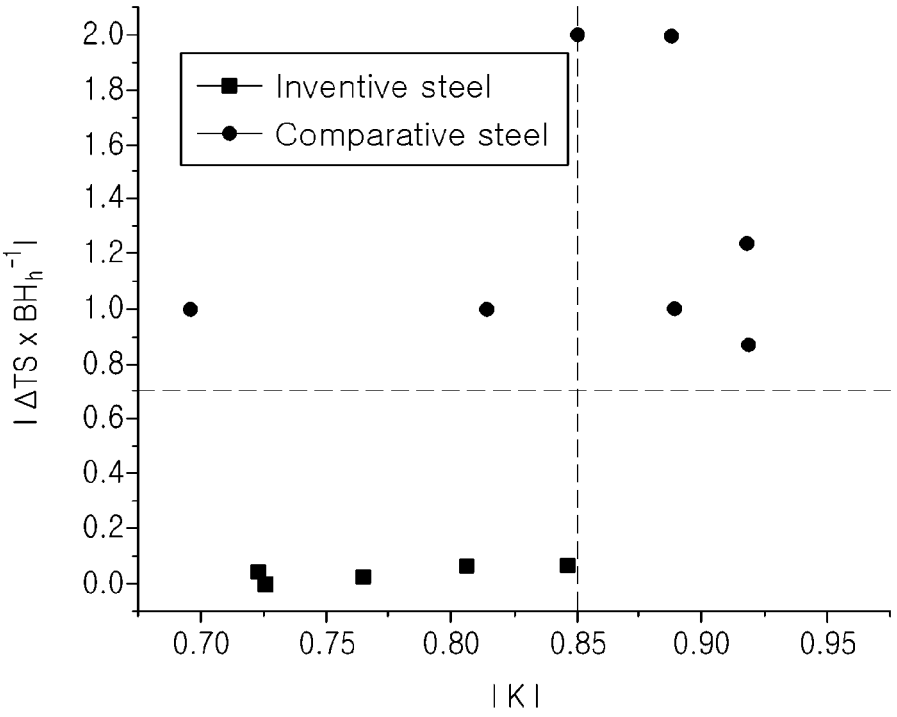
Inventive steel
Comparative steel
2.0
1.8
1.6
1.4
1.2
1.0
0.8
0.6
0.4
0.2
0.0
| ΔTS x BH_h^-1 |
0.70
0.75
0.80
0.85
0.90
0.95
| K |

HIGH-STRENGTH STEEL SHEET HAVING EXCELLENT THERMAL STABILITY, AND METHOD FOR MANUFACTURING SAME

TECHNICAL FIELD

The present disclosure relates to a steel sheet which may be applied to automobile chassis parts and the like, and more particularly, to a high-strength steel sheet having excellent thermal stability, and a method for manufacturing the same.

BACKGROUND ART

A conventional high-strength hot rolled steel sheet used for automobile chassis and frames is required to have excellent moldability in consideration of a part shape, while also being subjected to high-strength thinning according to the demand for lighter weight. In addition, in order to extremely increase durability of parts, a certain degree of a bake hardening (BH) which exhibits a hardening degree after painting is demanded.

Meanwhile, in some cases, heat is applied to a part or all of a steel sheet and a part for various purposes during manufacturing and use of steel, and in the heating process, the strength of the steel sheet and the part may be changed to deteriorate durability.

Usually, a solid-solubilized carbon amount in a structure is increased during heating, thereby forming clustering in dislocation, crystal grain boundary, and the like to form a final carbide. Simultaneously, structures such as martensite, bainite, and residual austenite in steel are changed together, so that steel strength is rapidly changed, and moldability and durability are affected.

As such, since the changes in structure, physical properties, and the like of steel in a heating process vary with the alloy composition and the microstructure of initial steel, and greatly depend on heat treatment conditions such as a heating temperature and a maintenance time, the focus has so far only been on a technology to suppress a decrease in strength during heating at a high temperature of 600° C. or higher.

For example, Patent Documents 1 and 2 suggest a technology of adding Cr, Mo, Nb, V, and the like, performing hot rolling, and then heat treating a steel sheet to secure strength at a high temperature, but the technology is only suitable for manufacturing of a thick steel material for construction. In addition, a certain level of strength was secured by adding large amounts of components such as Cr, Mo, Nb, and V to steel even in the case of exposure to a high temperature environment of 600° C. or higher for a long time, considering an environmental element in which a steel material for construction is unavoidably heated, for example, by fire, but since a heat treatment process using high-priced alloy elements for securing target physical properties is required, manufacturing costs may be excessive. In particular, thermal stability may be excessive for use in the exposure to a heating environment at 600° C. or lower for a short time.

Meanwhile, Patent Document 3 is a technology to secure the strength of a weld heat affected zone by adding Ti, Nb, Cr, Mo, and the like, and discloses a process of heating an area adjacent to a welded material which is melted by welding heat during arc welding to a high temperature of 600° C. or higher. When it is heated to an austenite region or to a higher temperature during the heating to a high temperature as such, Cr and Mo added to steel increase the hardenability of steel to form a low temperature phase such as bainite and martensite during subsequent cooling, thereby securing the strength. However, the technology to extremely increase the hardenability of a steel sheet has limitation in application to a steel sheet for an automobile which requires securing high moldability even after a heat treatment as required after manufacturing the steel sheet.

(Patent Document 1) Korean Patent Laid-Open Publication No. 1997-0043167

(Patent Document 2) Korean Patent Laid-Open Publication No. 2013-0002176

(Patent Document 3) Korean Patent Laid-Open Publication No. 2005-0085873

DISCLOSURE

Technical Problem

An aspect of the present disclosure is to provide a high-strength steel sheet having excellent physical properties required to be appropriately applicable to automobile chassis parts and the like, in particular, excellent moldability, bake hardening, and thermal stability, and a method for manufacturing the same.

An object of the present disclosure is not limited to the above description. The object of the present disclosure will be understood from the entire content of the present specification, and a person skilled in the art to which the present disclosure pertains will understand an additional object of the present disclosure without difficulty.

Technical Solution

According to an aspect of the present disclosure, a high-strength steel sheet having excellent thermal stability includes, by weight: 0.02 to 0.08% of carbon (C), 0.01 to 0.5% of silicon (Si), 0.8 to 1.8% of manganese (Mn), 0.01 to 0.1% of aluminum (Al), 0.001 to 0.02% of phosphorus (P), 0.001 to 0.01% of sulfur (S), 0.001 to 0.01% of nitrogen (N), 0.01 to 0.12% of titanium (Ti), 0.01 to 0.05% of niobium (Nb), and 0.001 to 0.2% of molybdenum (Mo), with a balance of Fe and other unavoidable impurities, wherein the steel sheet satisfies the following Relations 1 and 2, and as a microstructure, has the sum of area fractions of ferrite and bainite phases of 90% or more (excluding 100%) and includes one or more of residual martensite and MA phases:

$$|K| \leq 0.85 \quad \text{(Relation 1)}$$

wherein $K=-0.6-0.87[C]+0.03[Si]-0.14[Mn]+0.09[Ti]+0.01[Nb]^2$, and each element refers to a content by weight, $$5 \leq A \leq 20 \quad \text{(Relation 2)}$$

wherein $A=([Ti]/48+[Mo]/96)\times([Nb]/93)^{-1}$, and each element refers to a content by weight.

According to another aspect of the present disclosure, a method for manufacturing a high-strength steel sheet having excellent thermal stability includes: preparing a steel slab satisfying the alloy composition described above and Relations 1 and 2; heating the steel slab to a temperature within a range of 1100 to 1350° C.; hot rolling the heated steel slab at a temperature within a range of 850 to 1150° C. to manufacture a hot rolled steel sheet; and cooling the hot rolled steel sheet to a temperature within a range of 400 to 550° C. at an average cooling rate of 10 to 100° C./s and coiling the sheet.

Advantageous Effects

As set forth above, according to an exemplary embodiment in the present disclosure, a steel sheet having excellent thermal stability while having high strength to have excellent strength and bake hardening ability even after a heat treatment at a relatively low temperature may be provided.

Since the steel sheet may be heat-treated at a low temperature as compared with a heat treatment at a relatively high temperature required in a conventional steel sheet, the range of applicable use may be expanded.

DESCRIPTION OF DRAWINGS

FIG. 1 is a graph of a correlation between |K| values of alloy elements and a relationship [$\Delta TS \times BH_h^{-1}$] between a change in strength ($\Delta TS$) before and after a heat treatment and bake hardening amount ($BH_h$) after a heat treatment, in the examples of the present disclosure.

BEST MODE FOR INVENTION

The inventors of the present invention measured changes in tensile strength at room temperature for steels having various alloy compositions and different microstructures after a heat treatment at a temperature within a range of 100 to 600° C., and as a result, confirmed that the changes in tensile strength at room temperature depended on a slope of dynamic strength values measured during heating of a steel material.

Based on the fact, the present inventors confirmed that a steel sheet having excellent thermal stability may be provided by controlling the conditions of a steel sheet manufacturing process while optimizing a content relationship of specific elements, as a method for securing excellent thermal stability of a steel sheet, thereby completing the present disclosure.

Hereinafter, the present disclosure will be described in detail.

The high-strength steel sheet having excellent thermal stability according to an aspect of the present disclosure may include, by weight: 0.02 to 0.08% of carbon (C), 0.01 to 0.5% of silicon (Si), 0.8 to 1.8% of manganese (Mn), 0.01 to 0.1% of aluminum (Al), 0.001 to 0.02% of phosphorus (P), 0.001 to 0.01% of sulfur (S), 0.001 to 0.01% of nitrogen (N), 0.01 to 0.12% of titanium (Ti), 0.01 to 0.05% of niobium (Nb), and 0.001 to 0.2% of molybdenum (Mo).

Hereinafter, the reason that the alloy composition of the steel plate provided in the present disclosure is limited as described above will be described in detail.

Meanwhile, unless otherwise particularly stated in the present disclosure, the content of each element is by weight and the ratio of the structure is by area.

Carbon (C): 0.02 to 0.08%

Carbon (C) is the most economical and effective element for strengthening steel, and as the content is increased, a precipitation strengthening effect is increased or a fraction of a low temperature structure phase is increased, thereby inducing improvement of tensile strength.

When the content of C is less than 0.02%, a precipitation strengthening effect or low temperature phase formation is insufficient, so that it is difficult to secure target strength and bake hardening ability. However, when the content is more than 0.08%, a low temperature phase is excessively formed, and a carbide is formed, so that moldability and weldability are deteriorated. In addition, excessive addition of C causes the deterioration of a low temperature phase and the formation of an additional surplus carbide during a heat treatment in a range of 100 to 600° C., thereby greatly reducing strength and bake hardening ability after the heat treatment and further deteriorating moldability.

Therefore, C may be included at 0.02 to 0.08%, and more favorably 0.03% or more 0.07% or less.

Silicon (Si): 0.01 to 0.5%

Since Silicon (Si) deoxidizes molten steel, has a solid solution strengthening effect, and delays the formation of a coarse carbide, it is favorable to improve moldability. In addition, it has an effect of suppressing carbide formation during a heat treatment in a range of 100 to 600° C.

When the content of Si is less than 0.01%, an effect of delaying carbide formation is small, so that it is difficult to improve moldability and thermal stability is decreased. However, when the content is more than 0.5%, a red scale by Si is formed on the surface of a steel sheet during hot rolling to greatly deteriorate the surface quality of the steel sheet, and decrease ductility and weldability.

Therefore, Si may be included at 0.01 to 0.5%, and more favorably at 0.05% or more.

Manganese (Mn): 0.8 to 1.8%

Manganese (Mn) is an element effective for solid solution strengthening of steel, like Si, and increase the hardenability of steel to facilitate formation of a low temperature phase.

When the content of Mn is less than 0.8%, it is difficult to sufficiently obtain the effect described above, while when the content is more than 1.8%, hardenability is excessively increased to increase the fraction of a martensite phase and a segregation part greatly develops in a thickness center during slab casting in a soft casting process to deteriorate moldability. In addition, carbide is easily produced, and strength and a bake hardening amount may be greatly changed during a heat treatment in a range of 100 to 600° C.

Therefore, Mn may be included at 0.8 to 1.8%.

Aluminum (Al): 0.01 to 0.1%

Aluminum (Al) is an element which is added for deoxidation, and when the content is less than 0.01%, a deoxidation effect may not be sufficiently obtained. However, when the content is more than 0.1%, aluminum is bonded to nitrogen (N) in steel to be precipitated as AlN, which increases a risk of occurrence of corner cracks in a slab during soft casting and casting, and promotes occurrence of defects due to inclusion formation.

Therefore, Al may be included at 0.01 to 0.1%, and more favorably at 0.013% or more.

In the present disclosure, it is revealed that Al is soluble aluminum (Sol. Al).

Phosphorus (P): 0.001 to 0.02%

Phosphorus (P) is favorable to show both a solid solution strengthening effect and a ferrite transformation promotion effect, similarly to Si. However, when the content is more than 0.02%, brittleness by grain boundary segregation occurs, fine cracks occur easily during molding, and ductility and impact resistance properties are greatly deteriorated.

Meanwhile, since manufacturing costs are too high for controlling the content of P to less than 0.001%, it is economically unfavorable, and also unfavorable to secure a target strength level.

Therefore, P may be included at 0.001 to 0.02%.

Sulfur (S): 0.001 to 0.01%

Sulfur (S) is an impurity present in steel, and when the content is more than 0.01%, it is bonded to Mn in steel to form a non-metal inclusion, so that fine cracks occur easily during cutting processing of steel. Meanwhile, since it takes too much time during steel making operation to control the content of S to less than 0.001%, productivity is lowered.

Therefore, S may be included at 0.001 to 0.01%.

Nitrogen (N): 0.001 to 0.01%

Nitrogen (N) is a representative solid solution strengthening element with C, and is bonded to Ti, Al, and the like in steel to form a coarse precipitate. Generally, the solid solution strengthening effect of N is better than that of carbon, but as the content of N in steel is increased, the toughness is greatly deteriorated. Considering the fact, N may be included at 0.01% or less. Meanwhile, since it takes too much time during steel making operation to control the content of N to less than 0.001%, productivity is lowered.

Therefore, N may be included at 0.001 to 0.01%.

Titanium (Ti): 0.01 to 0.12%

Titanium (Ti) is a representative precipitation strengthening element with Nb and V, and forms coarse TiN in steel with strong affinity with N, having an effect of suppressing growth of crystal grains in a heating process for hot rolling. In addition, Ti remaining after a reaction with N is solid-solubilized in steel and bonded to C, thereby forming a TiC precipitate to contribute to improvement of steel strength.

When the content of Ti is less than 0.01%, it is difficult to sufficiently obtain the effect described above, while when the content is more than 0.12%, moldability is deteriorated due to the precipitation of coarse TiN and TiC.

Therefore, Ti may be included at 0.01 to 0.12%, and more favorably at 0.115% or less.

Niobium (Nb): 0.01 to 0.05%

Nb, which is a representative precipitation strengthening element with Ti and V, performs precipitation during hot rolling and is effective for improving steel strength and impact toughness due to the crystal grain refining effect by recrystallization delay.

It is favorable to include Nb at 0.01% or more for obtaining the effect, but when the content is more than 0.05%, moldability is deteriorated due to the formation of elongated crystal grains and the formation of coarse composite precipitates by excessive recrystallization delay during hot rolling.

Therefore, Nb may be included at 0.01 to 0.05%, and more favorably 0.011% or more and 0.049% or less.

Molybdenum (Mo): 0.001 to 0.2%

Molybdenum (Mo) increases the hardenability of steel to facilitate the formation of bainite in steel and has an effect of refining precipitates in ferrite grains, and thus, is effective for improving steel strength and thermal stability.

It is favorable to include Mo at 0.001% for obtaining the effect described above, but when the content is more than 0.2%, martensite is formed by an increase in quenching properties to rapidly decrease thermal stability, and it is unfavorable in terms of economic feasibility and securing weldability.

Therefore, Mo may be included at 0.001 to 0.2%, and more favorably 0.002% or more and 0.19% or less.

The steel sheet of the present disclosure may further include one or more of chromium (Cr), vanadium (V), nickel (Ni), and boron (B) at a total content of 1.5% or less, in addition to the alloy composition described above.

By adding one or more of chromium (Cr), vanadium (V), nickel (Ni), and boron (B), a precipitation effect may be further promoted, and formation of bainite at an appropriate fraction may be favorably achieved.

Meanwhile, among the elements described above, chromium (Cr) may be included up to 1.0%, and when the content is more than 1.0%, hardenability is excessive to deteriorate thermal stability of steel by a rapid increase in a martensite fraction, and ferroalloy costs are greatly increased, so that it is economically unfavorable. Therefore, Cr may be included at 1.0% or less, and more favorably at 0.8% or less.

The remaining component of the present disclosure is iron (Fe). However, since in the common manufacturing process, unintended impurities may be inevitably incorporated from raw materials or the surrounding environment, the component may not be excluded. Since these impurities are known to any person skilled in the common manufacturing process, the entire contents thereof are not particularly mentioned in the present specification.

It is preferred that in the steel sheet of the present disclosure having the alloy composition described above, the content relationship of specific elements in steel satisfies the following Relations 1 and 2:

$$|K| \leq 0.85 \quad \text{(Relation 1)}$$

wherein $K=-0.6-0.87[C]+0.03[Si]-0.14[Mn]+0.09[Ti]+0.01[Nb]^2$, and each element refers to a content by weight, $$5 \leq A \leq 20 \quad \text{(Relation 2)}$$

wherein $A=([Ti]/48+[Mo]/96)\times([Nb]/93)^{-1}$, and each element refers to a content by weight.

In the present disclosure, |K| represented by Relation 1 is a slop of a dynamic strength value measured during a temperature rise for heating steel to a specific temperature, and is based on deformation resistance of a steel material against an external force applied to the steel material at a given temperature.

As an example, it may be obtained by measuring a force applied to a material per unit area by applying an external force at a constant deformation rate while also heating a material at a constant heating rate in a test by a high temperature compression test or a high temperature tensile test for steel. A stress-temperature curve obtained therefrom refers to a sensitivity to a temperature of steel, and in particular, a K value which is the slop may be determined as an intrinsic physical property of steel.

In the present disclosure, when the |K| value is more than 0.85, the thermal stability of a steel sheet is insufficient, so that a change in a yield strength before and after a heat treatment in a range of 100 to 600° C. is increased.

Meanwhile, the change in yield strength before and after a heat treatment in a specific temperature range may show a further stable tendency by satisfying both Relations 1 and 2.

When the A value of Relation 2 is less than 5, precipitates having a diameter of 50 nm or more in the microstructure of a steel sheet is increased and the fraction of precipitates in crystal grains is decreased to lower thermal stability. This is due to a thermal change sensitized by decreased precipitates having a matrix structure and a matching interface. In addition, when the A value is more than 20, an effect of further improving thermal stability is decreased, and a large amount of high-priced alloy elements should be added, which is economically unfavorable.

The steel sheet of the present steel sheet which satisfies the alloy composition described above and also both Relations 1 and 2 may have intended physical properties, even in the case of performing a heat treatment for a short period of time at a relatively low temperature (for example, 600° C. or lower), when practically used as a part, and thus, its use to be applied may be expanded. In addition, it is useful for obtaining a steel sheet to be plated.

The steel sheet of the present disclosure which satisfies the alloy composition described above and also Relations 1 and 2 includes ferrite and bainite phases as main phases in a microstructure, and it is preferred that the sum of the fractions is 90% or more (excluding 100%) as an area fraction. When the sum of the fractions of ferrite and bainite is less than 90%, moldability is deteriorated by excessive formation of martensite and MA phases in the structure, and it is difficult to secure target thermal stability.

The ferrite phases favorably have an area fraction of 30 to 80%, and the bainite phase is also included at 10 to 60% in the main phases.

The steel sheet of the present disclosure may include one or more of martensite and MA (martensite and austenite mixed structure) phases as a residual structure other than the main phases, and these phases are included at an area fraction of 5% or less (excluding 0%), respectively to favorably act in securing the thermal stability of the steel sheet.

However, when each fraction of martensite and MA phases is more than 5%, the thermal stability of the steel sheet is deteriorated and local stress concentration becomes easy upon deformation, resulting in a risk of crack occurrence.

In addition, the steel sheet of the present disclosure may further include a pearlite phase, and the pearlite phase may be included at an area fraction of 5% or less (including 0%).

As described above, the steel sheet of the present disclosure has excellent bake hardening ability and hole expansion ratio while having high strength, by including the ferrite and bainite phases as main phases.

Specifically, it may have a tensile strength of 590 MPa or more, a yield ratio of 0.7 or more, a hole expansion ratio (HER) of 40% or more, and a bake hardening amount (BH) of 30 MPa or more.

In particular, since the steel sheet of the present disclosure has excellent thermal stability, it may be subjected to a heat treatment at a temperature within a range of 100 to 600° C., unlike a conventional steel sheet requiring a heat treatment at a high temperature of 600° C. or higher, and after the heat treatment, it may maintain a bake hardening amount ($BH_h$) of 30 MPa or more.

Furthermore, a change in strength before and after the heat treatment in the temperature range is extremely decreased, so that an absolute value of a relationship [$\Delta TS \times BH_h^{-1}$] between a change in strength ($\Delta TS$) before and after the heat treatment and a bake hardening amount ($BH_h$) after the heat treatment is 0.7 or less.

Hereinafter, a method for manufacturing a high-strength steel sheet having excellent thermal stability provided in the present disclosure, as another aspect of the present disclosure, will be described in detail.

The high-strength steel sheet according to the preset disclosure may be manufactured by performing a series of processes of [heating-hot rolling-cooling-coiling] of a steel slab satisfying the alloy composition and the component relationship suggested in the present disclosure.

Hereinafter, each of the process conditions will be described in detail.

[Steel Slab Heating]

In the present disclosure, it is preferred that a steel slab is heated before performing hot rolling to perform a homogenization treatment, in which the heating process may be performed preferably at 1100 to 1350° C.

When the heating temperature is lower than 1100° C., precipitates are not sufficiently solid-solubilized again, thereby decreasing the formation of fine precipitates in a process after hot rolling. However, when the temperature is higher than 1350° C., strength is decreased by coarsening of austenite crystal grains.

Therefore, the steel slab may be heated at a temperature within a range of 1100 to 1350° C.

[Hot Rolling]

The steel slab heated as described above may be hot rolled to manufacture a hot-rolled steel sheet, and the hot rolling may be performed at a temperature within a range of 850 to 1150° C.

During the hot rolling, when a final temperature, that is, a finish temperature is lower than 850° C., crystal grains elongated by excessive recrystallization delay develop, so that anisotropy is severe and moldability is deteriorated. However, when the hot rolling is started at a temperature higher than 1150° C. during the hot rolling, the temperature of the hot rolled steel sheet is raised to coarsen the size of crystal grains and deteriorate the surface quality of a hot rolled steel sheet.

[Cooling and Coiling]

The hot-rolled steel sheet manufactured as described above may be cooled to a specific temperature and then coiled. Specifically, the cooling may be performed to a temperature within a range of 400 to 550° C. at a cooling rate of 10 to 100° C./s, and then a coiling process may be performed in the temperature range.

A temperature at which the cooling is ended, that is, a coiling temperature is lower than 400° C., low temperature phases such as martensite and MA phases in steel are unnecessarily formed to deteriorate the thermal stability of the structure, so that moldability both before and after the heat treatment is deteriorated and an extent of strength decrease after the heat treatment is increased. However, when the temperature is higher than 550° C., bainite, martensite, and MA phases are not secured at appropriate fractions, so that it is difficult to secure a target level of bake hardening amount (BH) both before and after the heat treatment.

Meanwhile, in cooling to the temperature range described above, when the cooling rate is less than 10° C./s, crystal grains of a matrix structure is coarsened, structure heterogeneity occurs, and when the cooling rate is more than 100° C./s, problems such as an increase in low temperature phase fractions to deteriorate thermal stability may arise.

[Final Cooling]

The hot rolled steel sheet which is cooled and coiled according to the above may be cooled to approximately room temperature, and more specifically, may be cooled to room temperature to 200° C. at a cooling rate of 10 to 50° C./hour.

When the cooling rate is more than 50° C./hour during the cooling, some untransformed phases in steel may be easily transformed into martensite and MA phases, so that thermal stability is deteriorated. Meanwhile, when the cooling rate is controlled to less than 10° C./hour, a ferrite phase is excessively formed in the structure, so that it is difficult to secure a bake hardening amount (BH) and separate heating equipment and the like is required for slow cooling control, which is thus economically unfavorable.

The present disclosure may further include pickling and oiling the steel sheet obtained by completing the final cooling, and furthermore, may further include heating the pickled and oiled steel sheet to a temperature within a range of 450 to 740° C. to perform hot galvanizing.

The hot galvanizing may use a zinc-based plating bath, and the alloy composition in the plating bath is not particularly limited, but as an example, it may be a plating bath including 0.01 to 30 wt % of magnesium (Mg) and 0.01 to 50 wt % of aluminum (Al) with a balance of Zn and unavoidable impurities.

Hereinafter, the present disclosure will be specifically described through the following examples. However, it should be noted that the following Examples are only for describing the present disclosure in detail by illustration, and are not intended to limit the right scope of the present disclosure. The reason is that the right scope of the present disclosure is determined by the matters described in the claims and reasonably inferred therefrom.

MODE FOR INVENTION

Examples

Steel slabs having the alloy compositions of the following Table 1 were prepared, were subjected to a heat treatment at 1100 to 1350° C., and then were subjected to a finish hot rolling under the temperature conditions shown in the following Table 2, thereby manufacturing hot rolled steel sheets. At this time, the hot rolling was started at a temperature lower than the heating temperature. The hot rolled steel sheets manufactured as described above were cooled to the temperature shown in the following Table 2 at the cooling rate shown in the following Table 2, and then were coiled at the temperature. Thereafter, the steel sheets were finally cooled at a cooling rate of 10 to 50° C./hour to manufacture each steel sheet.

The mechanical properties and the microstructures for each steel sheet were measured, and the results are shown in the following Table 3.

First, DIN standard specimens were collected in a rolling direction, and tensile strength (TS) and elongation at break (El) for the specimens were measured at room temperature.

In addition, hole expansion ratio and bake hardening ability for the same specimens were evaluated. At this time, the hole expansion ratio was represented as an average value after measurement three times at room temperature.

The hole expansion ratio was determined by preparing a square specimen having a size of 120 mm each in length and width, punching a hole having a diameter of 10 mm in the center of the specimen by punching operation, pushing up the specimen with a cone with the burr on top, and calculating the diameter of the extended hole immediately before cracks occur in the circumferential part as a percentage to a first hole diameter (10 mm).

The bake hardening ability was represented by measuring a bake hardening amount (BH), in which a strength value (MPa, YS) at 2% predeformation at room temperature and a yield strength value (MPa, $YS_h$) after 2% predeformation, a heat treatment at 170° C. for 20 minutes, and then cooling to room temperature were measured, and the bake hardening amount (BH) was calculated as a difference between the strength values ($BH=YS_h-YS$).

Further, in order to measure a change in strength before and after the heat treatment, a tensile strength (TS) before the heat treatment and a tensile strength ($TS_h$) after a heat treatment at 500° C. for 10 minutes and then air cooling to room temperature were measured. In addition, a bake hardening amount after the heat treatment ($BH_h$) was measured in the same manner as described above for BH.

Thereafter, a relationship [$\Delta TS \times BH_h^{-1}$] between a difference ($\Delta TS=TS_h-TS$) between strength values before and after the heat treatment at 500° C. and the bake hardening amount ($BH_h$) after the heat treatment was calculated, and was represented as an absolute value.

Meanwhile, in order to analyze the microstructures of each steel sheet, observation at 3000 and ×5 0 magnifications was performed with SEM, and the fraction of each phase was measured.

At this time, the martensite phase and the MA phase were measured by performing Nital and Lepera etching on the specimen and then performing analysis at a ×1000 magnification using an optical microscope and an image analyzer.

TABLE 1

| | Alloy composition (wt %) | | | | | | | | | | | Relation | Relation |
|---|---|---|---|---|---|---|---|---|---|---|---|---|---|
| Classification | C | Si | Mn | Al | P | S | N | Ti | Nb | Cr | Mo | 1 | 2 |
| Comparative Steel 1 | 0.113 | 0.33 | 1.7 | 0.029 | 0.009 | 0.002 | 0.004 | 0.092 | 0.015 | 0.007 | 0.009 | 0.918 | 12.465 |
| Comparative Steel 2 | 0.011 | 0.34 | 1.6 | 0.025 | 0.011 | 0.002 | 0.003 | 0.101 | 0.021 | 0.592 | 0.007 | 0.814 | 9.641 |
| Comparative Steel 3 | 0.075 | 0.61 | 1.7 | 0.023 | 0.011 | 0.002 | 0.003 | 0.105 | 0.015 | 0.037 | 0.007 | 0.876 | 14.015 |
| Comparative Steel 4 | 0.043 | 0.31 | 2.1 | 0.028 | 0.012 | 0.001 | 0.003 | 0.033 | 0.042 | 0.009 | 0.007 | 0.919 | 1.684 |
| Comparative Steel 5 | 0.021 | 0.11 | 0.6 | 0.031 | 0.011 | 0.002 | 0.003 | 0.032 | 0.045 | 0.008 | 0.009 | 0.696 | 1.572 |
| Comparative Steel 6 | 0.078 | 0.11 | 1.7 | 0.028 | 0.012 | 0.002 | 0.003 | 0.151 | 0.015 | 0.395 | 0.135 | 0.889 | 28.223 |
| Comparative Steel 7 | 0.071 | 0.11 | 1.7 | 0.028 | 0.011 | 0.002 | 0.004 | 0.092 | 0.079 | 0.395 | 0.135 | 0.888 | 3.912 |
| Comparative Steel 8 | 0.072 | 0.13 | 1.4 | 0.032 | 0.011 | 0.001 | 0.004 | 0.065 | 0.015 | 0.581 | 0.006 | 0.849 | 8.783 |
| Comparative Steel 9 | 0.072 | 0.13 | 1.4 | 0.032 | 0.011 | 0.001 | 0.004 | 0.065 | 0.015 | 0.581 | 0.006 | 0.849 | 8.783 |

TABLE 1-continued

| Classification | Alloy composition (wt %) C | Si | Mn | Al | P | S | N | Ti | Nb | Cr | Mo | Relation 1 | Relation 2 |
|---|---|---|---|---|---|---|---|---|---|---|---|---|---|
| Inventive Steel 1 | 0.074 | 0.11 | 0.8 | 0.028 | 0.009 | 0.001 | 0.004 | 0.093 | 0.021 | 0.007 | 0.007 | 0.765 | 8.903 |
| Inventive Steel 2 | 0.032 | 0.32 | 0.8 | 0.025 | 0.012 | 0.002 | 0.004 | 0.082 | 0.036 | 0.009 | 0.031 | 0.723 | 5.247 |
| Inventive Steel 3 | 0.041 | 0.43 | 0.8 | 0.024 | 0.011 | 0.002 | 0.003 | 0.095 | 0.036 | 0.011 | 0.093 | 0.726 | 7.615 |
| Inventive Steel 4 | 0.049 | 0.35 | 1.3 | 0.025 | 0.009 | 0.001 | 0.004 | 0.092 | 0.015 | 0.395 | 0.125 | 0.806 | 19.956 |
| Inventive Steel 5 | 0.065 | 0.35 | 1.5 | 0.028 | 0.009 | 0.002 | 0.003 | 0.113 | 0.016 | 0.598 | 0.009 | 0.846 | 14.229 |

(In Table 1, Comparative Steels 8 and 9 have an alloy composition satisfying that of the present disclosure, but are classified as comparative steels since they are out of the range of the following manufacturing conditions.)

TABLE 2

| Classification | Finish rolling temperature (° C.) | Cooling rate (° C./s) | coiling temperature (° C.) |
|---|---|---|---|
| Comparative Steel 1 | 890 | 66 | 440 |
| Comparative Steel 2 | 890 | 67 | 440 |
| Comparative Steel 3 | 900 | 65 | 480 |
| Comparative Steel 4 | 900 | 69 | 480 |

TABLE 2-continued

| Classification | Finish rolling temperature (° C.) | Cooling rate (° C./s) | coiling temperature (° C.) |
|---|---|---|---|
| Comparative Steel 5 | 900 | 66 | 480 |
| Comparative Steel 6 | 900 | 72 | 480 |
| Comparative Steel 7 | 900 | 75 | 480 |
| Comparative Steel 8 | 890 | 45 | 650 |
| Comparative Steel 9 | 890 | 94 | 100 |
| Inventive Steel 1 | 890 | 66 | 440 |
| Inventive Steel 2 | 900 | 65 | 480 |
| Inventive Steel 3 | 880 | 62 | 480 |
| Inventive Steel 4 | 900 | 70 | 480 |
| Inventive Steel 5 | 890 | 71 | 445 |

TABLE 3

| Classification | Microstructure (% by area) F | B | M | MA | P | Before heat treatment TS (MPa) | BH (MPa) | HER (%) | YR | After heat treatment $TS_h$ (MPa) | $BH_h$ (MPa) | $\Delta TS \times BH_h^{-1}$ |
|---|---|---|---|---|---|---|---|---|---|---|---|---|
| Comparative Steel 1 | 44 | 44 | 9 | 3 | 0 | 932 | 98 | 29 | 0.79 | 901 | 25 | 1.24 |
| Comparative Steel 2 | 98 | 2 | 0 | 0 | 0 | 510 | 1 | 89 | 0.88 | 509 | 1 | 1.00 |
| Comparative Steel 3 | 66 | 5 | 20 | 9 | 0 | 947 | 70 | 35 | 0.71 | 812 | 33 | 4.09 |
| Comparative Steel 4 | 75 | 6 | 17 | 2 | 0 | 791 | 61 | 33 | 0.72 | 765 | 30 | 0.87 |
| Comparative Steel 5 | 96 | 3 | 1 | 0 | 0 | 325 | 1 | 102 | 0.88 | 324 | 1 | 1.00 |
| Comparative Steel 6 | 89 | 6 | 3 | 2 | 0 | 817 | 5 | 49 | 0.89 | 814 | 3 | 1.00 |
| Comparative Steel 7 | 87 | 7 | 4 | 2 | 0 | 865 | 3 | 37 | 0.91 | 863 | 1 | 2.00 |
| Comparative Steel 8 | 91 | 3 | 0 | 0 | 6 | 713 | 2 | 52 | 0.88 | 711 | 1 | 2.00 |
| Comparative Steel 9 | 69 | 5 | 24 | 2 | 0 | 801 | 81 | 39 | 0.65 | 743 | 21 | 2.76 |
| Inventive Steel 1 | 70 | 25 | 3 | 2 | 0 | 734 | 65 | 63 | 0.79 | 733 | 39 | 0.03 |
| Inventive Steel 2 | 79 | 17 | 3 | 1 | 0 | 633 | 57 | 81 | 0.81 | 631 | 40 | 0.05 |
| Inventive Steel 3 | 62 | 33 | 3 | 2 | 0 | 765 | 65 | 55 | 0.77 | 765 | 41 | 0 |
| Inventive Steel 4 | 66 | 30 | 2 | 2 | 0 | 813 | 67 | 60 | 0.79 | 810 | 41 | 0.07 |
| Inventive Steel 5 | 65 | 30 | 3 | 2 | 0 | 821 | 76 | 53 | 0.76 | 818 | 42 | 0.07 |

As shown in Tables 1 to 3, it was confirmed that Inventive Steels 1 to 5 which satisfied all of the alloy component system and the manufacturing conditions suggested in the present disclosure secured the target physical properties, by forming the structure constitution to be intended.

Meanwhile, Comparative Steels 1 to 7 are the examples which did not satisfy the alloy composition suggested in the present disclosure, and among them, Inventive Steels 1, 3, and 4 had excessive contents of C, Si, and Mn, respectively, so that Relation 1 was not satisfied, and thus, it was confirmed that a martensite phase and a MA phase were unnecessarily formed as a steel structure to deteriorate the hole expansion ratio of the steel sheet, and an extent of tensile strength decrease after the heat treatment was increased.

Comparative Steels 2 and 5 had insufficient contents of C and Mn, respectively, and had the decreased hardenability of the steel sheet, so that a low temperature phase fraction was not sufficiently formed, and thus, the strength of less than 590 MPa was secured and bake hardening ability was poor both before and after the heat treatment.

Comparative Steels 6 and 7 had excessive contents of Ti and Nb, respectively, and did not secure a certain fraction of a low temperature phase by excessive formation of a carbide, and thus, it was confirmed that the bake hardening amount was poor both before and after the heat treatment and the hole expansion ratio was decreased due to an increase in coarse precipitates.

Comparative Steels 8 and 9 satisfied the alloy component system of the present disclosure, but the coiling temperature thereof was out of the range of the present disclosure. Comparative Steel 8 was coiled at an excessively high temperature, so that a low temperature phase was not sufficiently formed in the structure, and thus, it was difficult to secure bake hardening ability before and after the heat treatment. When the coiling temperature was significantly low as in Comparative Steel 9, a low temperature phase was unnecessarily formed, so that a yield ratio was deteriorated and a change in strength and bake hardening amount before and after the heat treatment were shown to be large.

FIG. 1 is a graph of a correlation between |K| values of alloy elements and a relationship $[\Delta TS \times BH_h^{-1}]$ between a change in strength ($\Delta TS$) before and after the heat treatment and bake hardening amount ($BH_h$) after the heat treatment.

As shown in FIG. 1, it was confirmed that the |K| value was 0.85 or less and a change in strength before and after the heat treatment was small, that is, thermal stability was excellent, only in the inventive steels manufactured by the present disclosure. However, it was confirmed that the comparative steels having the |K| value out of the ranges suggested in the present disclosure showed a large change in the physical properties before and after the heat treatment.

Meanwhile, Comparative Steels 8 and 9 showing the |K| value of 0.85 or less had the manufacturing conditions (coiling temperature) out of the range of the present disclosure, and thus, the intended physical properties may not be secured.

The invention claimed is:

1. A steel sheet comprising, by weight: 0.02 to 0.08% of carbon (C), 0.01 to 0.5% of silicon (Si), 0.8 to 1.8% of manganese (Mn), 0.01 to 0.1% of aluminum (Al), 0.001 to 0.02% of phosphorus (P), 0.001 to 0.01% of sulfur (S), 0.001 to 0.01% of nitrogen (N), 0.01 to 0.12% of titanium (Ti), 0.01 to 0.05% of niobium (Nb), and 0.001 to 0.2% of molybdenum (Mo), with a balance of Fe and unavoidable impurities, wherein the steel sheet satisfies the following Relations 1 and 2, and as a microstructure, has a sum of area fractions of ferrite phase and bainite phase of 90% or more excluding 100% and includes one or more of residual martensite phase and MA phase, wherein the steel sheet has a bake hardening amount $BH_h$ of 30 MPa or more after a heat treatment at 100 to 600° C., and an absolute value of a relationship $[\Delta TS \times BH_h^{-1}]$ between a change in strength $\Delta TS$ before and after the heat treatment and a bake hardening amount $BH_h$ after the heat treatment is 0.7 or less:

$$|K| \leq 0.85 \quad \text{(Relation 1)}$$

wherein $K=-0.6-0.87[C]+0.03[Si]-0.14[Mn]+0.09[Ti]+0.01[Nb]^2$, and each element refers to a content by weight, $$5 \leq A \leq 20 \quad \text{(Relation 2)}$$

wherein $A=([Ti]/48+[Mo]/96)\times([Nb]/93)^{-1}$, and each element refers to a content by weight.

2. The steel sheet of claim 1, further comprising: a total content of 1.5% or less of one or more of chromium (Cr), vanadium (V), nickel (Ni), and boron (B).

3. The steel sheet of claim 1, wherein an area fraction of the martensite phase is 5% or less excluding 0%, and an area fraction of the MA phase is 5% or less excluding 0%.

4. The steel sheet of claim 1, wherein the steel sheet has a tensile strength of 590 MPa or more, a yield ratio of 0.7 or more, a hole expansion ratio HER of 40% or more, and a bake hardening amount BH of 30 MPa or more.

* * * * *